US006712490B2

(12) United States Patent
Bayer

(10) Patent No.: US 6,712,490 B2
(45) Date of Patent: Mar. 30, 2004

(54) FRAMEWORK FOR A LIGHTING FIXTURE

(75) Inventor: Georg Bayer, Plattsburgh, NY (US)

(73) Assignee: Schonbek Worldwide Lighting, Inc., Plattsburgh, NY (US)

( * ) Notice: Subject to any disclaimer, the term of this patent is extended or adjusted under 35 U.S.C. 154(b) by 0 days.

(21) Appl. No.: 10/121,134

(22) Filed: Apr. 11, 2002

(65) Prior Publication Data

US 2002/0154507 A1 Oct. 24, 2002

Related U.S. Application Data

(60) Provisional application No. 60/283,278, filed on Apr. 11, 2001.

(51) Int. Cl.[7] ..... F21S 8/04

(52) U.S. Cl. ..... 362/405; 362/404; 362/406

(58) Field of Search ..... 362/404, 405, 362/406; D26/81, 86, 154, 156, 155, 99, 84

(56) References Cited

U.S. PATENT DOCUMENTS 5,109,325 A * 4/1992 Bayer et al. ..... 362/433
5,144,541 A * 9/1992 Schonbek ..... 362/405
5,241,460 A * 8/1993 Schonbek ..... 362/405
5,906,430 A * 5/1999 Bayer ..... 362/404
5,921,668 A * 7/1999 Bayer ..... 362/404
6,241,370 B1 * 6/2001 Bayer et al. ..... 362/405

FOREIGN PATENT DOCUMENTS

DE 1497317 * 1/1966

OTHER PUBLICATIONS

Schonbek Worldwide Lighting Inc., *Schonbek Beyond Lighting*, copyright 1999, pp. 33, 38, 40, 42.

* cited by examiner

*Primary Examiner*—Sandra O'Shea
*Assistant Examiner*—Hargobind S. Sawhney

(57) ABSTRACT

A framework for a lighting fixture, such as a chandelier, includes frame members that contain or support decorative ornaments. The ornaments may be captured within the frame members without the use of attachment elements. The frame members may be formed with substantially parallel rails defining cages that are sized to hold beads, crystals or other decorative ornaments. In some embodiments, the ornaments may viewed from any angle without substantial obstruction by the frame member.

42 Claims, 9 Drawing Sheets

FRAMEWORK FOR A LIGHTING FIXTURE

RELATED APPLICATIONS

This application claims the benefit of the filing date under 35 U.S.C. §119 of U.S. Provisional Application Serial No. 60/283,278 filed Apr. 11, 2001, the subject matter of which is incorporated herein by reference in its entirety.

FIELD OF THE INVENTION

The present invention relates generally to lighting fixtures and, more particularly, to chandelier frame members for holding decorative ornaments.

DESCRIPTION OF RELATED ART

A chandelier is typically formed of frame members from which a plurality of crystal or glass ornaments are suspended to provide an overall decorative appearance. The ornaments are typically attached to a metal wire having a hook at one end that passes loosely through a hole in the crystal and a hook at the other end that passes through a hole in the chandelier framework. In such an arrangement, the ornaments are supported solely by the wire and hang below the frame member.

Other chandelier designs include arrangements whereby individual crystals may be positioned at different angles. An example of such an arrangement is shown in U.S. Pat. No. 5,109,325. In this arrangement, one end of a chandelier hook is glued to the ornament. The other end of the hook is attached to the frame member with an engagement mechanism that allows the ornament to be put in a non-vertical position.

SUMMARY OF THE INVENTION

In one aspect the invention involves a series of chandeliers, lighting fixtures, and lighting fixture components. In one embodiment, a chandelier is disclosed comprising a cage having at least three substantially parallel rails and a plurality of ornaments contained within the cage, wherein a section of the rails defines an opening for inserting ornaments into the cage.

In another embodiment, a chandelier is disclosed comprising a plurality of longitudinal frame members including at least two substantially parallel rails, the frame members including a row of ornaments contained between and parallel to the at least two substantially parallel rails.

In another embodiment, an arm for supporting a candle light is disclosed. The arm comprises at least three substantially parallel rails held at a lateral distance from each other, a plurality of ornaments captured within the at least three substantially parallel rails, and a support element held by the rails and constructed and arranged to support a candle light.

In yet another embodiment, a lighting fixture is disclosed. The lighting fixture comprises a cage having at least three rails spaced at a lateral distance from each other for capturing decorative elements, the cage having a longitudinal direction, and decorative elements stacked within the cage, wherein the at least three rails restrain the decorative elements from substantial movement in a direction transverse to the longitudinal direction of the cage.

In another embodiment, an apparatus for holding decorative ornaments in a slidable configuration is disclosed. The apparatus comprises a lighting element, at least rails forming a cage, the cage capturing the decorative ornaments so that the decorative ornaments are not restricted by the cage from sliding freely along a longitudinal direction of the cage, the cage restraining the decorative ornaments from substantial movement in a direction transverse to the longitudinal direction of the cage.

In yet another embodiment, a chandelier is disclosed comprising a frame member having a cage, and ornaments, wherein the cage holds the ornaments and restricts the movement of the ornaments in a direction transverse to a longitudinal direction of the cage without there being attachments between the ornaments and the frame member.

In another embodiment, a chandelier is disclosed comprising a frame member having a longitudinal direction and containing ornaments, and means for restricting movement of the ornaments in a direction transverse to the longitudinal direction of the frame member without attachments between the ornaments and the frame member.

In another aspect, the invention involves a series of methods. In one embodiment, a method of manufacturing a frame member for a chandelier is disclosed comprising providing a cage having at least three rails and an opening, inserting a plurality of ornaments through the opening, and sliding the plurality of ornaments within the cage to desired positions to create a stack of ornaments in the cage.

In another embodiment, a method of manufacturing a chandelier is disclosed. The method comprises providing a cage formed with at least two rails extending in a longitudinal direction, stacking a plurality of decorative ornaments along the cage such that the ornaments contact at least two of the at least two rails, and the at least two of the at least two rails prevent the decorative ornaments from substantially moving in a direction transverse to the longitudinal direction.

BRIEF DESCRIPTION OF THE DRAWINGS

It should be understood that the drawings are provided for the purpose of illustration only and are not intended to define the limits of the invention. Various aspects of the present invention will become apparent with reference to the following detailed description taken in conjunction with the accompanying drawings in which.

DETAILED DESCRIPTION

Figure 1:
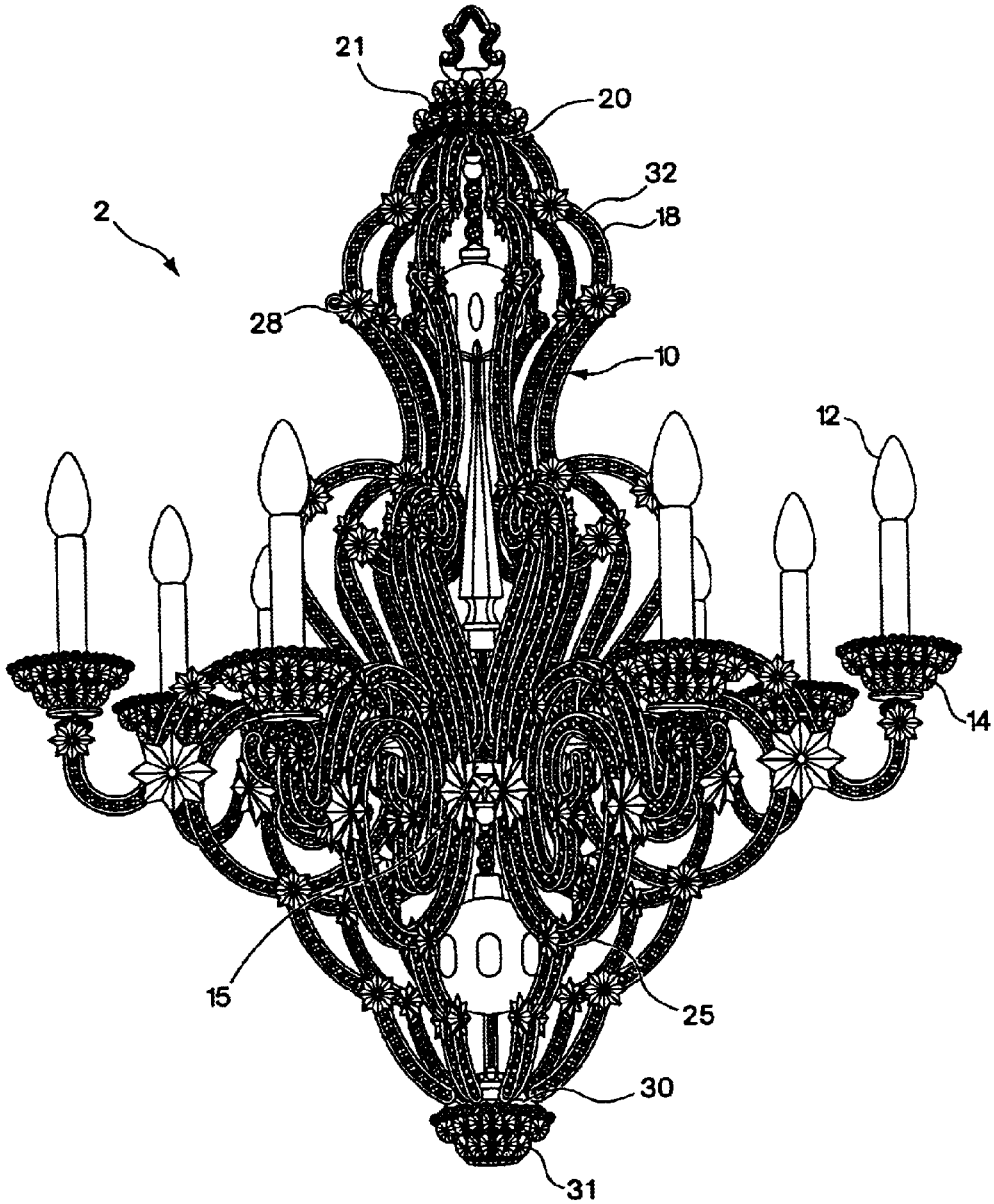
FIG. 1 is a perspective view of a chandelier in accordance with one embodiment of the present invention.

In one illustrative embodiment in accordance with the invention, a lighting fixture, such as a chandelier, includes frame members that capture decorative ornaments, such as beads, crystals, glass, or other appropriate decorative ornaments for a lighting fixture. According to this aspect of the invention, the chandelier holds ornaments within the frame members, as opposed to suspending ornaments from frame members or attaching ornaments to the exterior of the frame members. Each frame member may be attached to the lighting fixture in at least one location and may form part of a support structure for other lighting fixture elements such as lights, bobeches, electric cords, and ornamental features other than those captured within the frame member.

The frame members may include substantially parallel rails that form a cage which holds the decorative ornaments. The cage and the decorative ornaments may be positioned and dimensioned such that the cage captures and supports the ornaments. In embodiments with thin and/or darkly colored rails, or transparent rails, such a lighting fixture may give the appearance of ornaments floating in midair, as if the decorative ornaments were supported by invisible frame members. In some embodiments, the decorative ornaments of the lighting fixture can be viewed from different angles without being substantially blocked by frame members. The frame members may also help to protect the ornaments from damage by surrounding them and securing them from movement.

The use of frame members having a cage for holding a plurality of beads may lessen or eliminate the need for wires that attach the beads to the frame member. The frame members may also maintain ornaments in a selected orientation without the use of connection or attachment elements to attach the ornaments to the frame members. Rails of the frame member may be configured to hold the ornaments in a selected orientation, and the frame members may be shaped in various decorative patterns.

Rails may also be used in combination with attachment wires to support decorative ornaments. For example, a string of beads may be supported on one side by two rails and attached to the frame member with a wire that runs through the center of the string of beads. Two rails may also be positioned on opposite longitudinal sides of a string of beads and substantially protect, support and/or hold the beads, while a wire also helps to hold the beads. Depending on the size of the rails, the beads may not be viewable from all angles in such a configuration.

It may be desirable to conceal electrical wires or other wires within the frame members of the lighting fixture. In this regard, in some embodiments the frame members may include rails which are made from tubes or other hollow elements. Electrical wires may then be run through the tubes to their destination, such as a lighting element.

According to another aspect of the invention, it may be desirable to form frame members with a reduced number of manufacturing operations. For example, a frame member having two longitudinal rails and cross-pieces may be manufactured by laser cutting piece of sheet metal and then performing secondary operations on the cross-pieces. In one example, holes may be drilled or punched in the cross-pieces, and in other examples, a hole may be initially cut in the cross-piece, and in a secondary operation, the cross-piece may be twisted.

An illustrative embodiment of a chandelier 2 shown in FIG. 1 includes frame members 10 arranged in a radial pattern around a center plate 15, a center stem, or a center axis. Frame member 10 includes rails 18 which form a cage 25. The rails 18 hold decorative ornaments such as beads 32 within the cage 25. Other kinds of ornaments may be used, such as glass ornaments, crystals, listels, lights, light emitting diodes, colored stones, or any other kind of ornaments suitable for use with lighting fixtures.

In the embodiment shown in FIG. 1, the frame members are attached at a top of the chandelier 2 to a top center plate 20, and at a bottom of the chandelier 2 to a bottom center plate 30. The top center plate 20 and/or the bottom center plate 30 may be plates, discs or rings, or any other suitable connection plate. In some embodiments, covers 21, 31 are placed over or around the center plates 20, 30 to obscure the center plates 20, 30 from view. The frame members 10 extend radially outwardly from the center plate 15 and support lighting elements, such as candle lights 12, and/or other features. Bobeches 14 or other cup decorations surround the base of the candle lights 12 and rosettes 28 are attached at various positions on the frame members 10. Rosettes 28, bobeches 14, and other decorative pieces are not required, and may be of any suitable shape or configuration if present.

Frame member 10, in addition to containing the beads 32 within the cage 25, may hold other ornaments that are suspended or supported outside of the cage 25. For example, a crystal may be suspended by a wire from one of the rails 18 or one of the rosettes 28.

For purposes herein, the term "frame member" refers to any structure used to capture, hold, support or contain ornaments. A frame member does not need to contain or surround ornaments in order to be considered a frame member. In some embodiments, a frame member may provide structural support to the overall lighting fixture, but is not required to do so.

For purposes herein, the term "bead" refers to any ornament that is suitable for use in a chandelier or lighting fixture. Crystals used as ornaments may be cut crystals or molded crystals, or any other type of crystals known to one of skill in the art. The term "rail" is not limited to a specific length, cross-sectional shape, or material disclosed herein.

Figure 2:
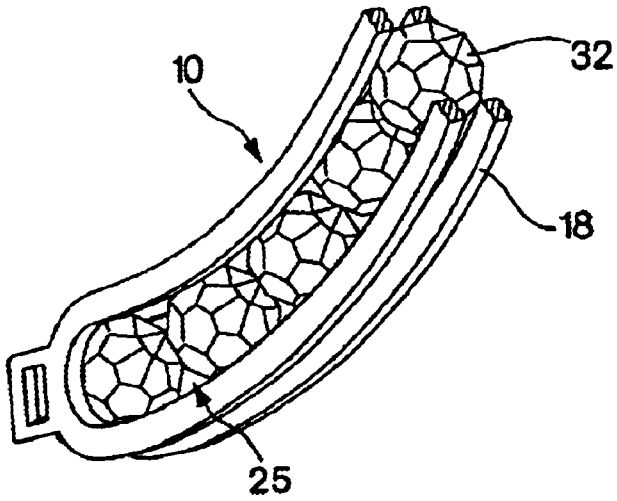
FIG. 2 is a perspective view of a portion of a frame member assembly in accordance with one embodiment of the invention.

One embodiment of a portion of frame member 10 holding decorative beads 32 is shown in FIG. 2. Four rails 18 form a cage 25 for holding beads 32. The rails 18 are substantially parallel for holding beads 32 that are similar in size. The rails 18 are laterally spaced from each other such that the beads 32 can move freely along the cage 25 in a longitudinal direction. In this respect, the rails 18 may form a channel along which beads 32 may slide. The cage 25 is sized, however, such that the beads 32 cannot be removed from the cage 25 through the lateral spacing between the rails 18 without bending, moving or removing one of the rails 18. In certain sections, the rails 18 may be spaced such that beads 32 within the cage 25 encounter significant friction when moved along the cage 25. The cage 25 does not need to be smooth or continuous in that it may have indentations or scalloped sections which hold ornaments at selected locations. The rails 18 may be non-parallel for holding beads 32 of different shapes and sizes within the same cage 25. For example, one section of the cage 25 may enclose a larger area and hold a larger bead 32 than another section of the same cage 25. The cage 25 may narrow or expand either gradually or abruptly.

Certain of the beads 32 may be connected to each other with a wire such as a monofilament line or a steel wire to form bead strings. It is to be appreciated that beads 32 may be held together in bead strings or may be present separately within the frame members 10 without any attachments. When using eleven millimeter beads, each of the bead strings preferably includes twenty or fewer beads 32.

Figure 3:
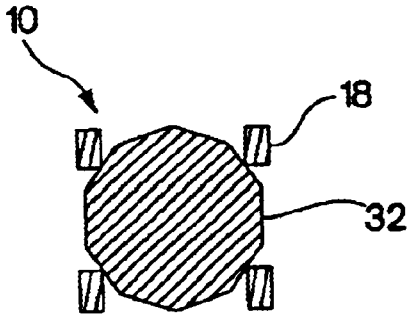
FIG. 3 is a cross-sectional view of the frame member assembly of FIG. 2.

FIG. 3 shows a cross-section of the portion of the frame member 10 shown in FIG. 2. The four rails 18 capture and contain bead 32, which, at its maximum diameter, substantially fills the cage 25. The bead 32 may extend beyond the borders formed by the rails 18. For example, a suitably sized bead 32 in the shape of a plus-sign ("+") will be captured by the rails 18, but will extend beyond the borders formed by the rails 18. In the embodiment shown in FIG. 3, the bead 32 is held in a selected orientation by the rails 18. Certain shapes of beads, such as a smooth spherically shaped bead, may not be maintained in a selected orientation by the rails 18. In one embodiment, the rails 18 have a rectangular cross-section, but as may be appreciated by one of skill in the art, the cross-sectional shapes of the rails 18 may be square, rectangular, circular, triangular, or other.

Figure 4:
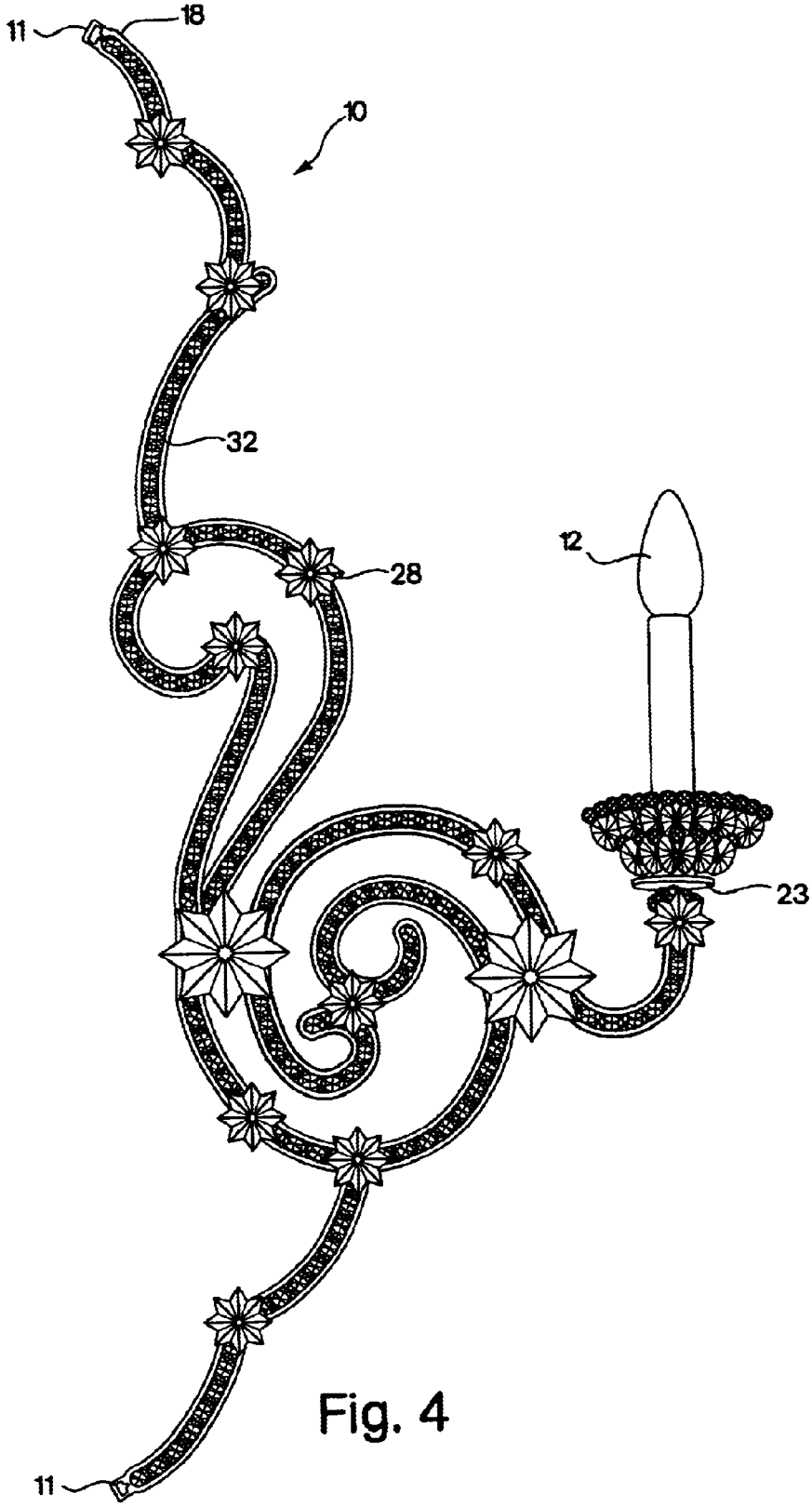
FIG. 4 is front view of a frame member for a lighting fixture.

FIG. 4 shows a frame member 10 containing a plurality of beads 32. Frame member 10 includes rails 18 which contain beads 32. Frame member 10 is shaped into a decorative pattern and rosettes 28 are attached to the frame member 10 at different locations. Cutouts 11 in the rails 18 allow for attachment to a connection element such as a top center plate 20 (FIG. 1). In this embodiment, a candle light 12 is held by a support element 23 attached to frame member 10. The scrollwork pattern of this particular frame member 10 is designed to be displayed in a vertical orientation as shown, but may be displayed in one of many other orientations. Of course, frame member 10 may include other scrollwork patterns or designs.

Figure 5:
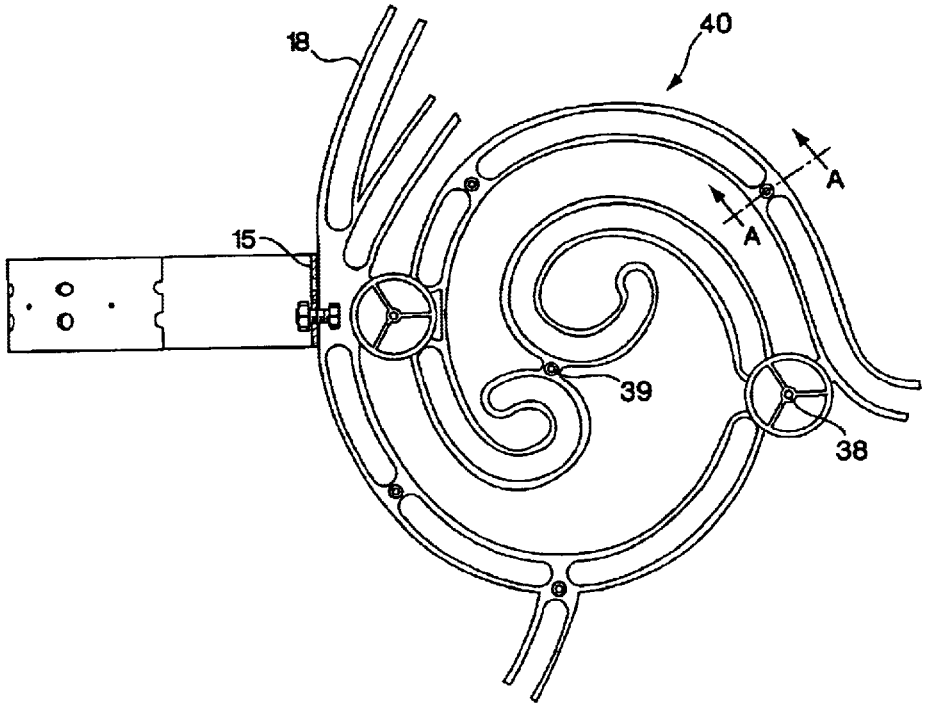
FIG. 5 is a front view of a frame member including a frame pattern in accordance with one embodiment of the invention.

FIG. 5 shows part of a frame portion 40 which may be used to form a portion of frame member 10 (FIG. 1). In a preferred embodiment, two frame portions 40 are cut from sheet metal using a laser cutting machine and are connected to form frame member 10. As will be evident to one of skill in the art, frame portions 40 may be made from any suitable material and with any suitable manufacturing process. Frame portion connectors 38, 39 are used to attach two frame portions 40 together to form a frame member 10. Frame portion connectors 38, 39 also interconnect sections of rails 18 within the same frame portion 40. The frame member 10 is attached to center plate 15, but may be attached to other frame members or other lighting fixture elements. It is to be appreciated that frame member 10 need not be comprised of frame portions 40. In some embodiments, rails 18 may be separately constructed and attached together.

Figure 6:
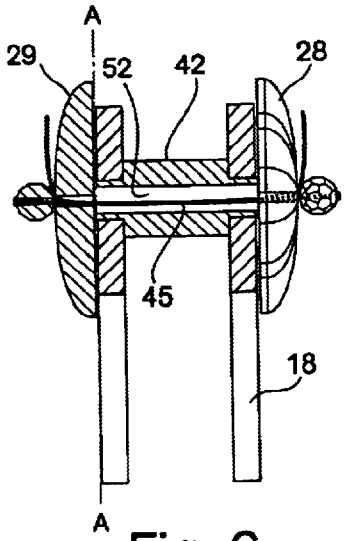
FIG. 6 is a cross-sectional view of a frame member in accordance with one embodiment of the invention.

In one embodiment, two frame portions 40 are attached with spacers 42 as shown in FIG. 6. FIG. 6 is a cross-sectional view along A—A of FIG. 5 with the addition of an attachment assembly. The spacers 42 help provide structural support to the frame member 10 (FIG. 1) such as by stiffening the rails 18 so that the rails 18 do not get pushed together and damage the beads 32. The spacers 42 may be any suitable shape and made from any suitable material. Rosettes 28 or other cover elements may be used to obscure the spacer 42 from view. Rosettes 28 may also be used to help attach the frame portions 40 (FIG. 5) to one another such that the rails 18 do not spread apart and allow beads 32 to escape. For example, a wire 45, such as a steel wire or string, may be attached to a first rosette 28, inserted through a passageway 52 in the spacer 42, and attached to a second rosette 29. Other methods of securing frame portions 40 together will be apparent to one of skill in the art.

Figure 7:
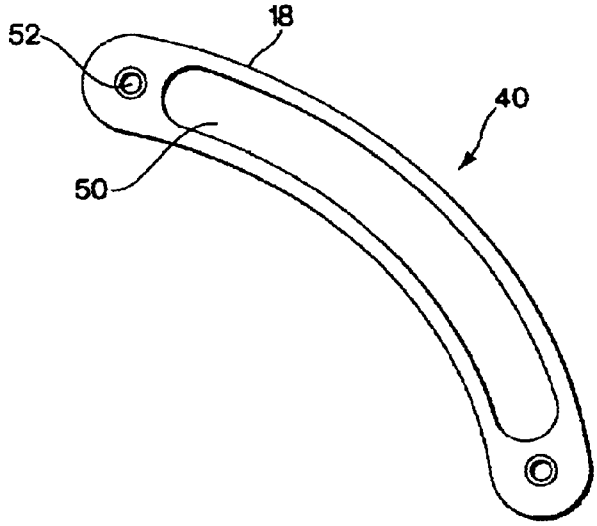
FIG. 7 is a front view of a portion of a frame member in accordance with one embodiment of the invention.

FIG. 7 shows an insertion opening 50 in the frame portion 40 to allow for insertion of beads into the cage. In this illustrative embodiment, the separation between two of the rails 18 is slightly greater toward one end to form the insertion opening 50. In another embodiment, one of the rails 18 may be thinner toward one end, thereby forming the insertion opening 50. Insertion opening 50 is preferably one and a half bead diameters in length to facilitate insertion of the beads, but any suitable length or transverse size may be used. Insertion openings 50 may be located at any number of locations and are not restricted to the ends of frame portions 40.

Once the beads are inserted, two rosettes 28 and 29 are placed on either side of the frame member and attached through passageway 52, as shown in FIG. 6, so that the rosette 28 covers the insertion opening 50 to prevent the beads from exiting the cage. Rosettes 28 and 29 may be attached to frame member 10 by a string, wire, screw, a nut and bolt arrangement, an adhesive, or by any other suitable manner. It is to be appreciated that rosettes 28 and 29 do not need to be placed over every insertion opening 50, and other structures or methods may be used to contain the beads once they have been inserted. For example, a bead slightly larger than the insertion opening 50 may be squeeze-fit into the cage so that it obstructs the insertion opening 50. A bead that is asymmetric may be inserted into the insertion opening 50 in one orientation, and then reoriented so that it obstructs the opening 50. An extra rail or pivoting flap may be employed to obstruct the insertion opening 50. The flap may be hinged on the inside of the cage so that it opens inwardly to allow insertion of beads, and positioned so that it does not open outwardly, thereby preventing beads from exiting the cage. Insertion openings 50 are preferably positioned throughout the frame member 10 such that bead strings need not be more than twenty beads in length. As will be evident to one of skill in the art, the preferred maximum bead string length may vary with the size, shape and tolerances of the beads. In alternative embodiments, where bead strings are longer or shorter than twenty beads, insertion openings 50 may be positioned further apart or closer together.

Other arrangements for the insertion of beads into the cage are contemplated. For example, the rails may be constructed such that they are flexible enough to allow for beads to be inserted at a midpoint between two frame pattern connectors by snap fitting the beads into the cage (not shown). In such an embodiment, the rails return to their original positions and contain the beads after a bead is inserted into the cage.

Another alternative arrangement for inserting beads includes a rail that is detachably secured at one end to another rail or a connection plate (not shown). The rail may be detached at one end and pivoted away from the other rails, allowing beads or bead string to be inserted. Once beads are inserted, the rail is re-attached to the connection plate or other rails, and the beads are contained within the frame member. In some embodiments, beads or other ornaments may also be inserted at an end of the cage before the frame member is attached to a connection plate.

Figure 8:
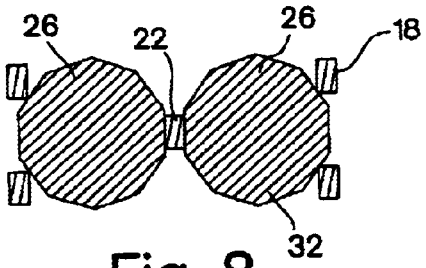
FIG. 8 is a cross-sectional view of a frame member assembly in accordance with another embodiment of the invention.
Figure 9:
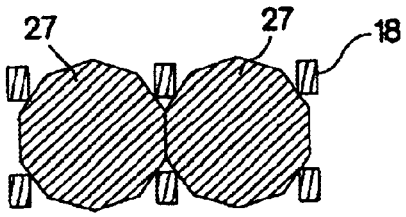
FIG. 9 is a cross-sectional view of a frame member assembly in accordance with another embodiment of the invention.

While in a some embodiments the beads 32 are stacked end-to-end in a single file as illustrated in FIG. 2, the beads 32 may also be held side-by-side or stacked in different arrangements. For example, as shown in a cross-sectional view in FIG. 8, a fifth rail 22 could be added to the interior of the cage 25 (FIG. 2) to form two triangular cages 26, wherein each triangular cage 26 is made up of two rails 18 and a shared third rail 22. Six rails 18 could be used to form two square cages 27, as shown in FIG. 9. Nine rails could be used to form four cages in a two by two pattern (not shown). Spherical beads within adjacent cages can be positioned directly adjacent one another, or they can be offset longitudinally to allow for a closer fit.

It is to be appreciated that the rails 18 are not required to be separate members. For example, in other embodiments (not shown), a cylinder or an ornament channel formed with panels may be used to hold ornaments and may include cutouts, holes or slots for viewing the ornaments. In some embodiments, rails 18 may not be parallel to one another at various cross-sectional locations, but may nevertheless be substantially parallel along a length of frame member 10. For instance, frame member 10 may include four rails 18 that are each formed in a zig-zag pattern and slightly offset longitudinally from one another. In such an embodiment, a short section of two rails 18 may not be parallel, but along a longer length of frame member 10, the two rails 18 may be substantially parallel. A cage can be a raceway, that is, a longitudinal path for sliding ornaments. In some embodiments, two rails 18 can form a raceway.

Figure 10:
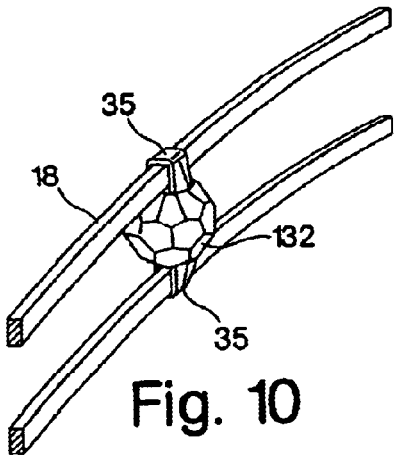
FIG. 10 is a perspective view of a frame member in accordance with yet another embodiment of the invention.

In another illustrative embodiment, a cage may be formed with two rails 18 as shown in FIG. 10. The beads 132 are molded to have slots 35 that receive rails 18. The beads 132 are placed on the rails 18 at the ends of the rails, or in some embodiments, the beads 132 may have snap-fit slots that attach to the rails 18.

Figure 11:
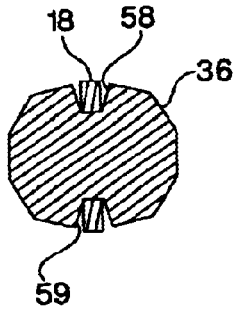
FIG. 11 is a cross-sectional view of a frame member assembly in accordance with another embodiment of the invention.

Certain shapes of crystals, glass, or beads may be held between two rails 18 without slots 35. FIG. 11 shows an example of a shaped ornament 36 that can be captured between two rails 18. Shaped ornament 36 has a top groove 58 and a bottom groove 59 which allow the rails 18 to restrict movement of the shaped ornament 36 in a direction transverse to the longitudinal direction of the rails 18. In this embodiment, the ornaments may be added at the longitudinal end of the rails 18 and slid along the raceway to a selected position. The frame members and the ornaments may be dimensioned such that the ornaments can be inserted from a lateral direction into the raceway in one orientation and then turned such that they are secured by the frame member. Additional ornaments may then be stacked to fill the length of the raceway and maintain the orientation of the ornaments.

Figure 12:
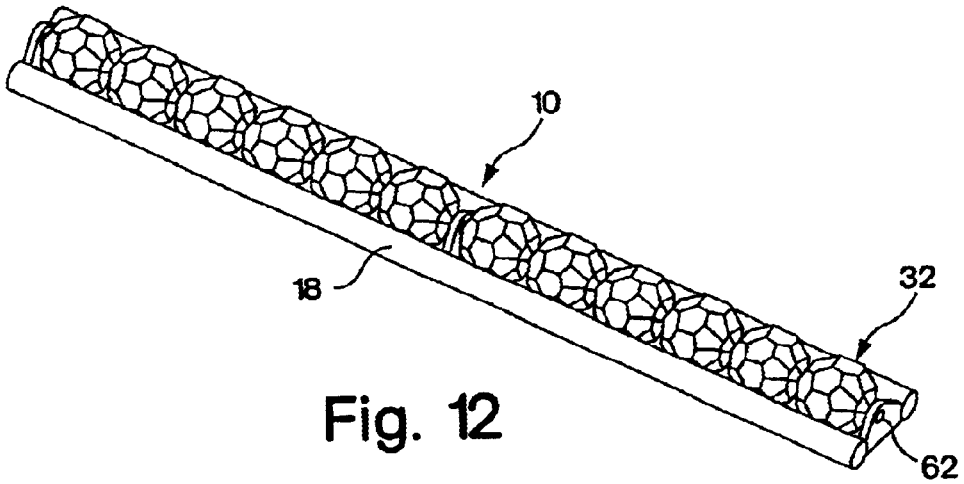
FIG. 12 is a perspective view of a frame member assembly in accordance with another embodiment of the invention.

To facilitate the running and/or concealment of wires such as electric power wires, a frame member 10 may be configured with rails 18 that are tubes, as illustrated by way of example in FIG. 12. In such a configuration, an electric wire (not shown) may be hidden from view along its path of travel by passing it through the interior of rail 18. Brackets 60 may be used to connect the rails 18 together by spot-welding a bracket 60 to each rail 18, although any suitable method of connecting the rails 18 may be employed. The brackets 60 may have holes 62 through which wire such as steel wire or monofilament line may be passed to help maintain the position of a bead string. Having the holes 62 configured to be parallel to the bead strings may be particularly advantageous for attaching bead strings to the frame member 10. In this regard, an end of a wire may be passed through the hole 62 and tied into a retaining knot. Similarly, an end of a monofilament line may be passed through the hole 62 and melted to produce a retaining bead.

Figure 13:
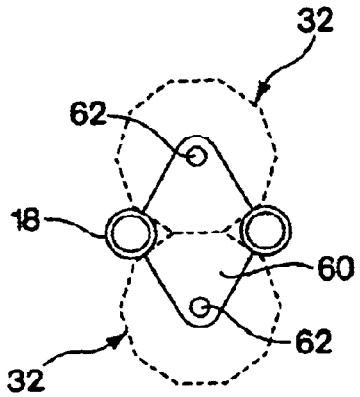
FIG. 13 is a cross-sectional view of an alternative embodiment of the frame member assembly shown in FIG. 12.

The location of the beads 32 is not limited to one side of the frame member 10. For example, beads 32 may be held on both sides of the frame member via a combination of the rails 18 and the monofilament line or wire, as shown by way of example in FIG. 13. In this configuration, a single bracket 60 having two holes 62 may be used to connect the rails 18, or two brackets 62 may be used.

Figure 14:
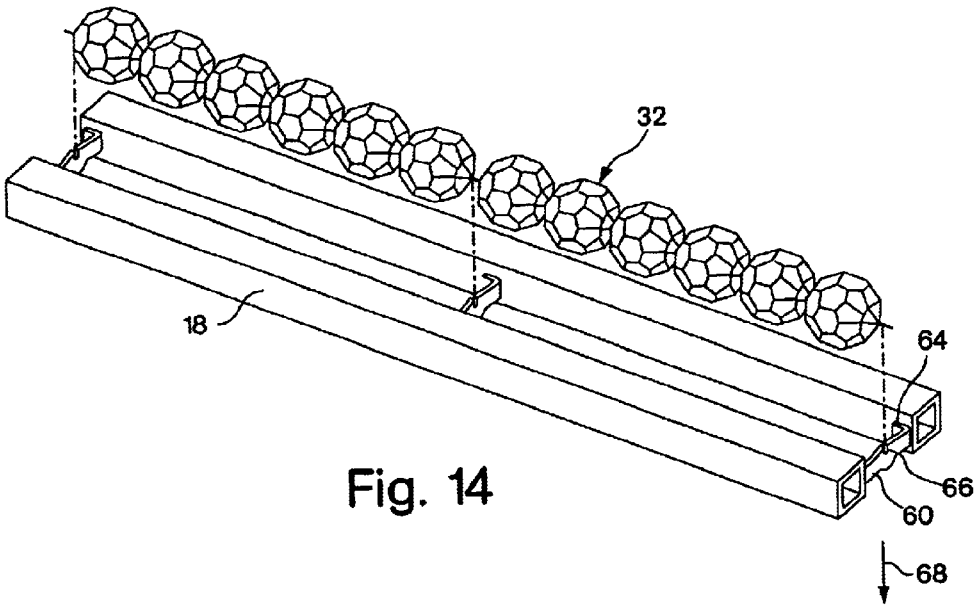
FIG. 14 is a perspective view of a frame member assembly in accordance with yet another embodiment of the invention.

It is to be appreciated that use of the tubes as rails is not limited to round tubes such as the ones shown in FIG. 12. For example, rails 18 formed with square tubes may be provided as shown in FIG. 14. In this embodiment, the rails 18 are connected with brackets 60 which have ears 64 bent at a 90 degree angle to the brackets 60. The ears 64 are welded to the rails 18 and may be configured such that a monofilament line or wire of a bead string can be placed into the bracket 60 via a slot 66. The bracket 60 may then be pressed in direction 68 to deform the bracket and close the slot 66 so that the monofilament line or wire is captured. It is to be understood that other methods of connecting the rails 18 or retaining the monofilament line may be employed.

Figure 15:
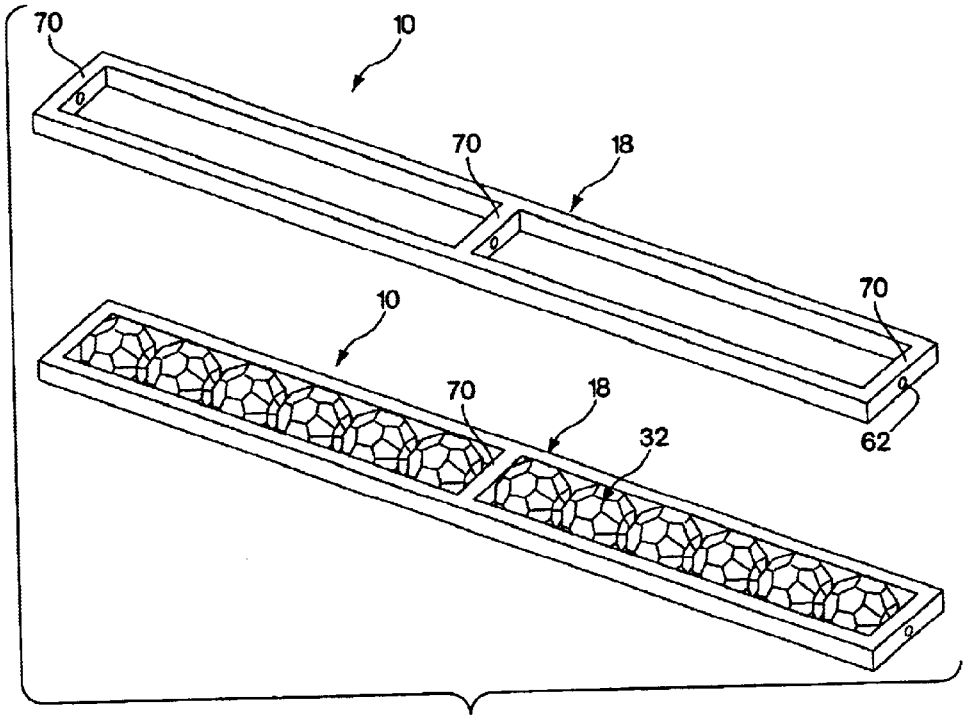
FIG. 15 and is a perspective view of a frame member assembly in accordance with another embodiment of the invention.

As described above, two rails 18 may be used to capture and/or support beads 32. In one embodiment, instead of using brackets to connect two rails 18, the rails 18 are formed as one integral piece. FIG. 15 shows a laser-cut frame member 10 that is configured to retain beads 32. Cross-pieces 70 integral to the frame member 10 connect the rails 18. The cross-pieces 70 may be provided with holes 62 for retaining the monofilament line. The holes 62 may be punched holes or may be holes provided by another suitable method such as drilling.

Figure 16:
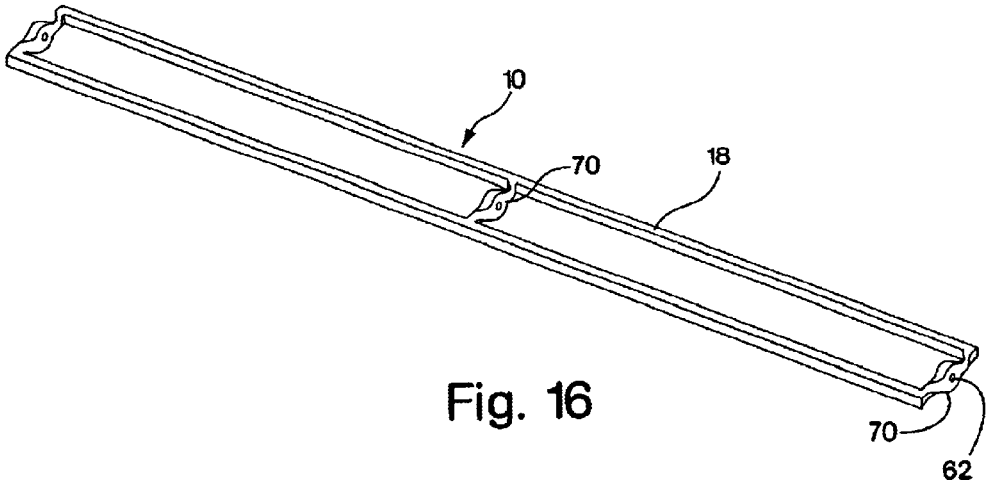
FIG. 16 is a perspective view of an alternative embodiment of the frame member assembly shown in FIG. 15.

In another embodiment, an example of which is shown in FIG. 16, an integral frame member 10 that does not require a secondary operation for forming a hole 62 is provided. In this embodiment, the frame member 10 is laser-cut and includes cross-pieces 70 with holes 62 that are also laser-cut. The cross-pieces 70 are then twisted 90 degrees so that the holes 62 are parallel with the bead strings.

The chandelier 2 may be made in any suitable manner. The frame portions 40 may be laser-cut from sheet material such as stainless steel, mild steel, or other suitable material. The frame portions 40 may be joined with spacers, wires, ferrules, adhesive, or nuts and bolts. The frame members 10 or frame portions 40 may be formed with one piece of material bent into a selected shape. The individual frame members 10 may be attached together or attached to a connection element. Electric cords may run along the interior or the exterior of the frame members, or within the rails 18 themselves.

Having described particular embodiments of the invention in detail, various modifications and improvements will readily occur to those skilled in the art. Such modifications and improvements are intended to be part of this disclosure and within the spirit and scope of the invention. Accordingly, the foregoing description is by way of example only and the invention is defined by the following claims and their equivalents.

What is claimed is:

1. A chandelier comprising:

a cage having at least three substantially parallel rails; and a plurality of ornaments contained within the cage;

wherein a section of the rails defines an opening for inserting ornaments into the cage.

2. The chandelier recited in claim 1, wherein a non-parallel section of the rails defines the opening for inserting ornaments into the cage.

3. The chandelier recited in claim 1, wherein one of the at least three substantially parallel rails has one section that is thinned to form an opening for inserting ornaments into the cage.

4. The chandelier recited in claim 1, further comprising a rosette covering the opening.

5. The chandelier recited in claim 1, wherein the cage has at least four substantially parallel rails.

6. The chandelier recited in claim 5, wherein the cage is formed with two frame portions connected together, each frame portion including two rails.

7. The chandelier recited in claim 6, wherein the frame portions are made of laser-cut sheet metal.

8. A chandelier comprising:

a plurality of longitudinal frame members including at least two substantially parallel rails, each frame member including a row of ornaments contained between and parallel to the at least two substantially parallel rails.

9. The chandelier recited in claim 8 wherein the ornaments are connected together in a longitudinal string that is held substantially parallel to the at least two substantially parallel rails.

10. The chandelier recited in claim 9, wherein the ornaments are connected together in the longitudinal string by a wire that is attached to ends of the frame member.

11. The chandelier recited in claim 8, wherein the frame members include at least three substantially parallel rails.

12. The chandelier recited in claim 8, wherein the frame members include at least four substantially parallel rails.

13. An arm for supporting a candle light, comprising:

at least three substantially parallel rails held at a lateral distance from each other;

a plurality of ornaments captured within the at least three substantially parallel rails; and a support element held by the rails and constructed and arranged to support a candle light.

14. The arm recited in claim 13, wherein the at least three substantially parallel rails comprise at least four substantially parallel rails.

15. The arm recited in claim 13, in combination with the candle light.

16. A lighting fixture, comprising:

a cage having at least three rails spaced at a lateral distance from each other for capturing decorative elements, the cage having a longitudinal direction; and decorative elements stacked within the cage;

wherein the at least three rails restrain the decorative elements from substantial movement in a direction transverse to the longitudinal direction of the cage.

17. The lighting fixture recited in claim 16, wherein the decorative elements are one of beads and crystals.

18. The lighting fixture recited in claim 16, wherein the decorative elements are connected together to form a decorative element string.

19. The lighting fixture recited in claim 16, wherein a plurality of the cages are arranged radially around a center axis of the lighting fixture.

20. The lighting fixture recited in claim 16, further comprising a lighting element attached to the cage.

21. The lighting fixture recited in claim 16, wherein the at least three rails are substantially parallel.

22. The lighting fixture recited in claim 16, wherein the cage further comprises an opening for insertion of the decorative elements.

23. The lighting fixture recited in claim 22, wherein two of the rails are spaced slightly further apart along a longitudinal section of the cage to form the opening.

24. The lighting fixture recited in claim 22, wherein a section of the cage has a thinned rail which forms the opening.

25. The lighting fixture recited in claim 22, further comprising a rosette that at least partially covers the opening.

26. An apparatus for holding decorative ornaments in a slidable configuration, comprising:

a lighting element;

at least three rails forming a cage, the cage capturing the decorative ornaments so that the decorative ornaments are not restricted by the cage from sliding freely along a longitudinal direction of the cage, the cage restraining the decorative ornaments from substantial movement in a direction transverse to the longitudinal direction of the cage.

27. The apparatus recited in claim 26, wherein the cage captures a stack of the decorative ornaments such that the longitudinal movement of the decorative ornament is limited.

28. The apparatus recited in claim 27, wherein the at least three rails comprises at least four rails.

29. The apparatus recited in claim 28, wherein the cage is formed with two frame portions that are connected together.

30. The apparatus recited in claim 29, wherein the frame portions are formed of laser-cut sheet metal.

31. The apparatus recited in claim 26, wherein the at least three rails are substantially parallel.

32. A chandelier, comprising:

a frame member having a cage; and ornaments, wherein the cage holds the ornaments and restricts the movement of the ornaments in a direction transverse to a longitudinal direction of the cage without there being attachments between the ornaments and the frame member.

33. The chandelier recited in claim 32, comprising a plurality of frame members having cages.

34. The chandelier recited in claim 33, wherein the frame members are arranged in substantially vertical planes when the chandelier is in a hanging position.

35. A chandelier, comprising:

a frame member having a longitudinal direction and containing ornaments; and means for restricting movement of the ornaments in a direction transverse to the longitudinal direction of the frame member without attachments between the ornaments and the frame member.

36. The chandelier recited in claim 35, wherein the frame member further comprises means for inserting ornaments into the frame member.

37. A method of manufacturing a frame member for a chandelier, comprising:

providing a cage having at least three rails and an opening;

inserting a plurality of ornaments through the opening; and sliding the plurality of ornaments within the cage to desired positions to create a stack of ornaments in the cage.

38. The method recited in claim 37 further comprising:

at least partially obstructing the opening.

39. The method recited in claim 38, wherein the step of at least partially obstructing the opening comprises attaching a rosette to the cage so that the rosette at least partially obstructs the opening.

40. A method of manufacturing a chandelier, comprising:

providing a cage formed with at least two rails extending in a longitudinal direction;

stacking a plurality of decorative ornaments along the cage such that the ornaments contact at least two of the at least two rails, and the at least two of the at least two rails prevent the decorative ornaments from substantially moving in a direction transverse to the longitudinal direction.

41. The method of claim 40, further comprising:

connecting the plurality of decorative ornaments together with a wire so that an ornament string is formed.

42. The method of claim 41, further comprising:

attaching an end of the wire to an end of the cage, the end of the cage having a hole that extends in a direction parallel to the ornament string.

* * * * *